United States Patent [19]

Tamba et al.

[11] Patent Number: 4,873,945

[45] Date of Patent: Oct. 17, 1989

[54] CYLINDER BLOCK CONSTRUCTION FOR V-TYPE ENGINES

[75] Inventors: Shinichi Tamba; Hitomi Miyake, both of Hyogo, Japan

[73] Assignee: Kawasaki Jukogyo Kabushiki Kaisha, Kobe, Japan

[21] Appl. No.: 183,527

[22] Filed: Apr. 14, 1988

Related U.S. Application Data

[63] Continuation of Ser. No. 863,247, May 14, 1986, abandoned.

[30] Foreign Application Priority Data

May 17, 1985 [JP] Japan ..... 60-106376

[51] Int. Cl.[4] ..... F02B 75/22

[52] U.S. Cl. ..... 123/55 R; 123/195 R

[58] Field of Search ..... 123/55 R, 55 V, 55 VE, 123/55 VS, 55 VF, 195 R, 41.74

[56] References Cited

U.S. PATENT DOCUMENTS

| | | | |
|---|---|---|---|
| 1,404,015 | 1/1922 | Edwards | 123/55 VE |
| 2,660,156 | 11/1953 | Kopf et al. | 123/55 V |
| 2,681,050 | 6/1954 | Schnurle et al. | 123/55 VE |
| 4,092,958 | 6/1978 | Hale | 123/73 PP |
| 4,212,281 | 7/1980 | Ernest | 123/55 VE |
| 4,237,847 | 12/1980 | Baugh et al. | 123/195 R |
| 4,373,475 | 2/1983 | Kirk | 123/73 PP |
| 4,480,601 | 11/1984 | Skatsche et al. | 123/41.74 |
| 4,559,908 | 12/1985 | Flaig et al. | 123/195 R |
| 4,565,163 | 1/1986 | Ishimi et al. | 123/55 VS |
| 4,609,030 | 9/1986 | Heater et al. | 164/137 |
| 4,637,110 | 1/1987 | Yamagata | 123/193 C |
| 4,802,447 | 2/1989 | Corbett | 123/73 PP |

*Primary Examiner*—David A. Okonsky

*Attorney, Agent, or Firm*—Eric P. Schellin

[57] ABSTRACT

A one-piece crankcase and cylinder block structure for V-type internal combustion engines is disclosed, which is formed by casing and comprises a crankcase with its one end wall side opened and a cylinder block including at least a pair of right and left cylinders opposed to each other at 90°. The cylinders are formed to project at their skirt portion into inside of the crankcase forming a longitudinal space between the protruded ends of the skirt portions to house a camshaft. Another space is defined adjacent to the opened side of the crankcase between the protruded ends of the skirt portions to house a camshaft gear. Since the construction is such that, in casting, the directions in which the segments of mold and the cores are ejected from the casting are uniformly distributed, and the distance over which the cores and mold segments are ejected is greatly minimized. Thus, a relatively small casting machine can be employed to properly cast such a one-piece crankcase and cylinder block structure.

5 Claims, 4 Drawing Sheets

CYLINDER BLOCK CONSTRUCTION FOR V-TYPE ENGINES

This application is a continuation of application Ser. No. 863,247, filed May 14, 1986 abandoned.

BACKGROUND OF THE INVENTION (1) Field of the Invention

The present invention relates in general to V-type internal combustion engines and more particularly to a cast one-piece crankcase and cylinder block construction for such engines.

(2) Description of the Prior Art

In the prior art relating to internal combustion engines it has been common to construct V-type engines from a cast crankcase and a separate cylinder assembly which is assembled onto the crankcase by bolts. Usually, casting produces a crankcase opened at its bottom side wall, and the opening of the crankcase is later closed with a side wall which is formed by a separate process of casting. To install a crankshaft, a bore is drilled in the end wall of the crankcase, sized to a larger diameter than the crankshaft webs so that the crankshaft can be inserted into position inside the crankcase through the bore. After the insertion, the drilled bore is filled to a smaller diameter enough to fittingly carry the end bearing supporting the end of the crankshaft. Thus, not only have the entire assembling operation of an engine demanded considerable manpower and time but also the structure required to support the end bearing in the end wall bore have resulted in increasing the overall weight of the crankcase.

Furthermore, because of the design requirement that the crankcase first comes without its bottom side wall, the cylinder block has to be later made integral with the crankcase, adding an extra amount of labor and with a resultant increase of weight from the attaching devices employed to put them together.

The reason for the unavailability of a one-piece crankcase and cylinder block casting is largely attributable to the limited capacities of the conventional casting machines. In casting, the cores are pulled out from the crankcase in a direction that is substantially perpendicular to the axis of the crankshaft and so are the cores from the cylinder block. To make a one-piece crankshaft and cylinder block, the molding machine has to be impractically large enough to achieve this pulling over a sum distance for the cores from the crankcase and those for the cylinder block.

Another problem with the conventional V-type engine designs is that a gear case has to be mounted externally of the crankcase to house the cam gear, which also added extra machining and assembling operations to the entire crankcase buildup.

It is this situation that gave rise to the present invention.

SUMMARY OF THE INVENTION

The present invention provides a novel V-type internal combustion engine construction and a method for producing it. The engine is built from a combined crankcase and cylinder block casing opened at its one end wall, to which a separately cast end wall is later assembled. This engine construction makes it possible to simplify the entire casting process. Also, the engine and particularly the cylinder assembly can be constructed in an easier method and in reduced weight as well.

It is therefore a primary object of the present invention to provide a new method for building a V-type engine which is assembled from component castings produced in a simplified casting process.

It is another object of the present invention to provide a V-type engine which can be built up in an easy manner.

It is a further object of the present invention to provide such an engine which is lightweight.

An additional object of the present invention is to provide such an engine with a reduced number of cam mechanism components.

A still further object of the present invention is to provide such an engine of liquid cooling type in which the formation of a precise cooling line to the cylinder liquid jacket is insured.

In one preferred embodiment according to the present invention, the V-type engine is constructed from a one-piece crankcase and cylinder block casing opened at its one end wall, a side in which the crankshaft is supported in bearings at one end, with the paired cylinder blocks opposed at 90°.

In another preferred embodiment, the V-type engine is also built from a one-piece crankcase and cylinder block construction opened at its one end wall, with the camshaft arranged between the skirts of the opposed cylinder banks, with a space defined adjacent to the opened end of the crankcase casting for the camshaft gear.

In a further preferred embodiment, the V-type liquid cooling engine is assembled from a one-piece crankcase and cylinder block structure which is cast together with a liquid cooling jacket formed in the external surface of each cylinder bank and a cooling line formed parallel with the crankshaft for communication with the liquid cooling jackets in the cylinder banks. In casting, the cooling jackets are configured such that their cores are drawn from their respective associated cylinder bank in the same direction as the cores are from the cylinder bores in the block. In addition, since the cooling line is disposed to run parallel with the axis of the crankshaft, the core for the line is pulled in the same direction in which the core for the crankshaft is removed. In this manner, the liquid cooling jackets and cooling line can be given shape in substantially the same casting operation in which the integrated crankcase and cylinder block structure is configured.

These and other features and advantages of the present invention will be move fully understood and appreciated from the following description of specific embodiment taken together with the accompanying drawings.

DETAILED DESCRIPTION OF PREFERRED EMBODIMENTS

The preferred embodiments of the present invention will be described in great detail in conjunction with the accompanying drawings.

Figure 1:
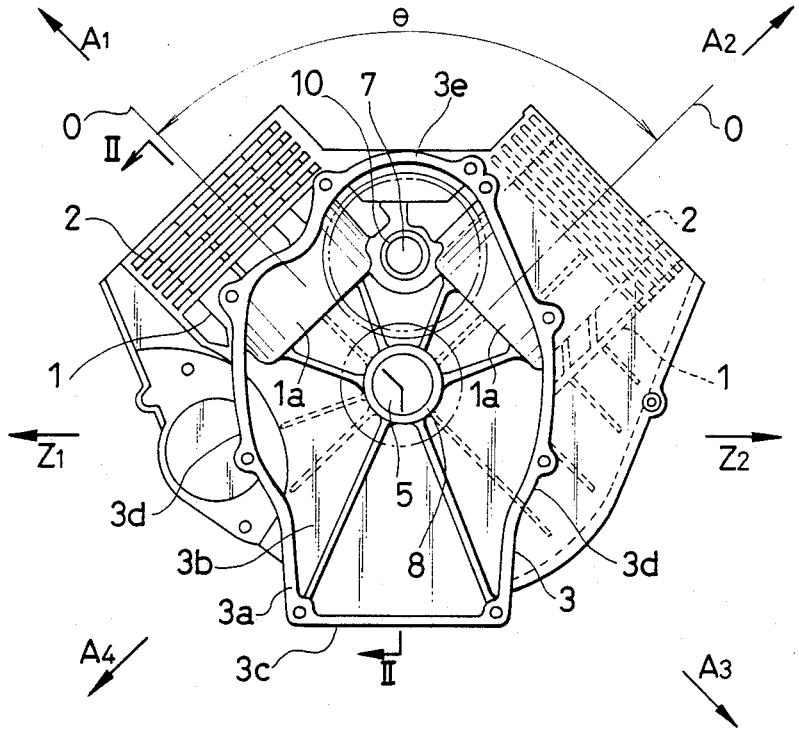
FIG. 1 is a transverse cross-sectional view of a cylinder block in a vertical shaft V-type internal combustion engine, as seen in the direction of the arrow I in FIG. 2, constructed in accordance with a preferred embodiment of the present invention.

Referring first to FIG. 1, a vertical shaft V-type air-cooling internal combustion engine includes a pair of right and left cylinders 1 opposed at 90° in the V-shape cylinder block layout. The external walls of the cylinders 1 are formed into multiple layers of fins 2 that are arranged in a cycle about the axis O of the cylinder bore, provided for enhanced heat-dissipation of the heat generated by the cylinders in operation. Inside the crankcase 3 of the engine is disposed a crankshaft 5 in a vertical position. Each cylinder 1 projects at its bottom wall or skirt portion 1*a* into the inside of the crankcase 3.

Between the skirt portions 1*a* of the opposed cylinders 1 is disposed a camshaft 7 that runs substantially parallel with the crankshaft along the apex of the cylinder block V-shape layout inside the crankcase 3.

In construction, the crankcase 3 is cast integrally with the cylinder block including the paired cylinders 1 in a one-piece structure, preferably made of aluminum, opened at its end wall side 3*a*, a side in which the crankshaft 5 is supported at its one end in bearings. Thus, this one-piece structure is composed in the main of that end wall 3*b* opposite to the opening 3*a*, the bottom wall 3*c*, both side walls 3*d* and the top wall 3*e* of the crankcase 3 and the paired cylinders 1, with the bosses 8 and 10 formed in the end wall 3*b* for carrying the proper ends of the crankshaft and the camshaft, respectively, in bearings.

Figure 2:
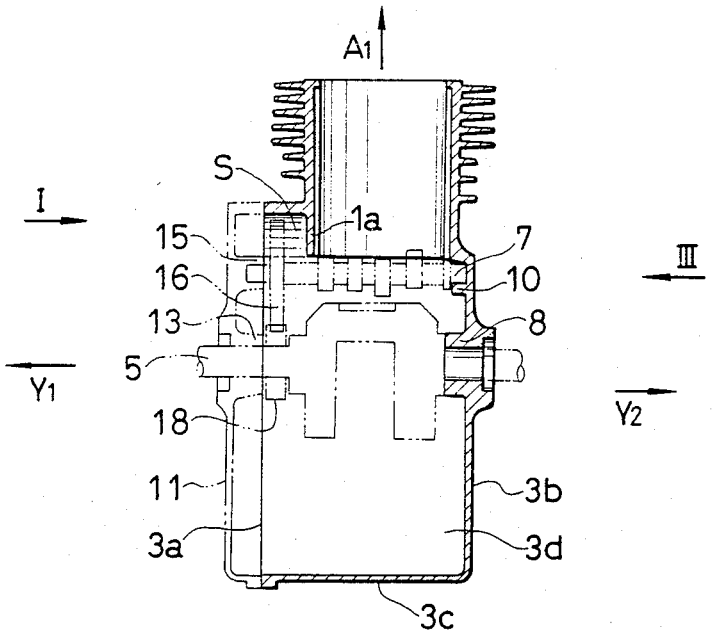
FIG. 2 is a longitudinal cross-sectional view of the cylinder block, taken along the line II—II of FIG. 1.

As may best shown in FIG. 2, which is a cross-sectional view taken along the line II—II of FIG. 1, a lid 11 is detachably installed in the opening 3*a* closing the crankcase 3. Formed in the lid 11 are bosses 13 and 15 for supporting the opposite ends of the crankshaft 5 and the camshaft 7, respectively, in bearings.

The cylinders 1 are built to project at their skirt portion 1*a* into the inside of the crankcase 3 to define a longitudinal space between them for housing the camshaft 7. Also, another space S is formed under the projecting cylinder skirt portions 1*a* adjacent to the opening 3*a* of the crankcase, provided to house the camshaft gear 16.

In the assembled form of engine, the crankshaft 5 is supported at both ends thereof by the bosses 8 and 13 through bearings (not shown) while the bosses 10 and 15 carries the camshaft 7 also through bearings (not shown), with the camshaft gear 16 fixedly mounted thereon in mesh engagement with the crankshaft gear 18 for being driven by the latter.

To facilitate the drawing of the core from inside the crankcase 3 in the direction of the arrow Y1 in casting process, the bottom wall 3*c* is inclined to gradually depart from the crankshaft 5 as it goes toward the open end 3*a* of the crankcase (FIG. 2).

Figure 3:
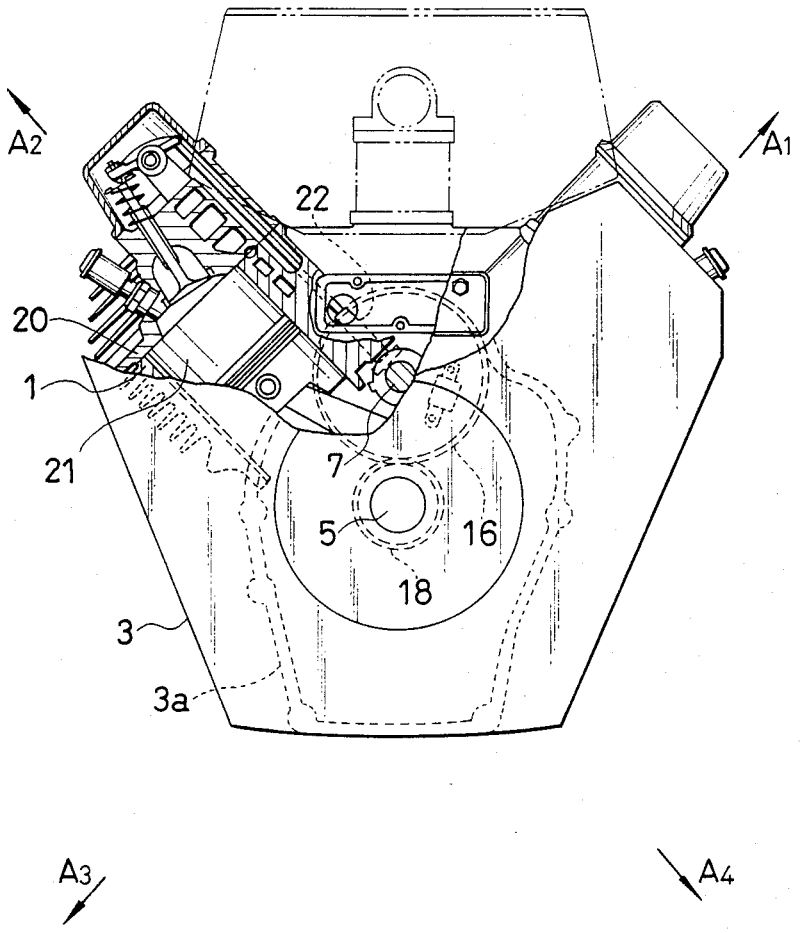
FIG. 3 is a transverse cross-sectional view of the cylinder block, seen in the direction of the arrow III in FIG. 2.

Referring then to FIG. 3, which is a view of the engine with its cylinder block, as seen from the direction of the arrow III in FIG. 2, the cylinder arrangement consists in the main of a cylinder head 20, a piston 21 and exhaust and inlet valves 22, only one of which is shown, in each cylinder bank.

Referring again to FIG. 1, in the formation of a one-piece crankcase and cylinder block construction, the core from the left cylinder bore is drawn in the direction of the arrow A1 while the core from the right cylinder bore in the direction of the arrow A2. In FIG. 2, the core from the crankcase is pulled in the direction of the arrow Y1.

The casting operation employed to form the one-piece crankcase and cylinder block structure shown in FIGS. 1 and 2 consists in the drawing of six separate segments of mold which are ejected in different radial directions A1, A2, A3, A4, Y1 and Y2. An alternative set of mold segments may be drawn in the directions of the arrows A1, A2, Z1, Z2, Y1 and Y2 to produce a casting of similar configuration in FIGS. 1 and 2.

To construct an engine, the crankshaft 5 and camshaft 7 are inserted into position inside the crankcase 3 through the opening 3*a* and the lid 11 is then installed in the opening to close the crankcase.

Figure 4:
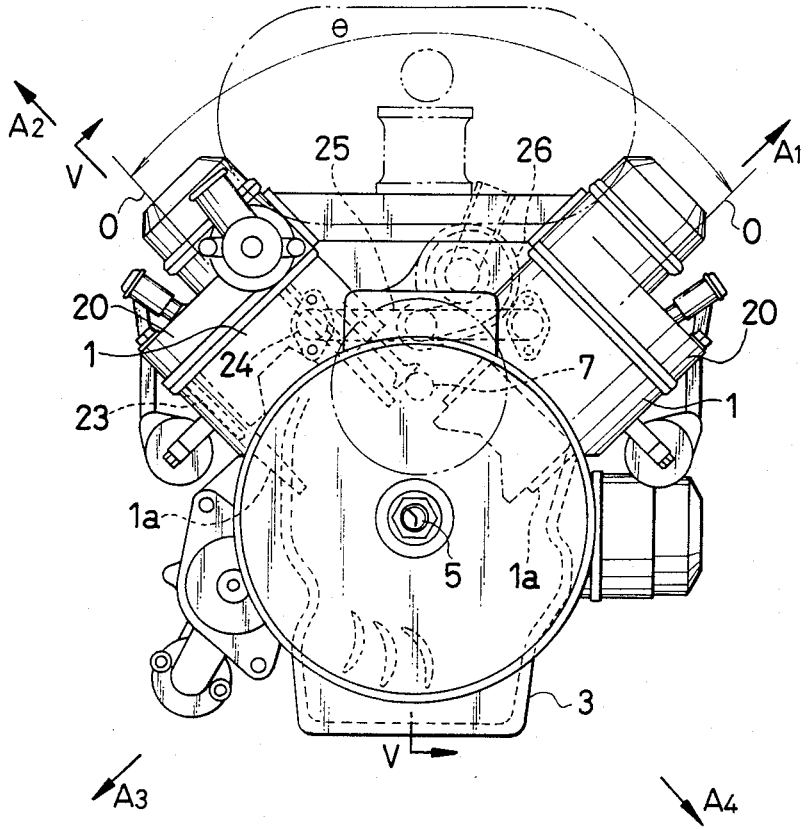
FIG. 4 is a transverse cross-sectional view of a vertical shaft V-type liquid cooling internal combustion engine built in accordance with a second preferred embodiment of the present invention.

FIG. 4 illustrates a vertical shaft V-type liquid cooling internal combustion engine constructed in accordance with a second preferred embodiment of the present invention, which consists in the main of a pair of right and left cylinders 1 in the V-shape cylinder block layout and a crankcase 3 cast in a one-piece with the cylinders 1.

Each of the cylinders 1 is formed in its external surface into a liquid cooling jacket 23 in place of the fins 2 in the previous embodiment. In the top portion of the one-piece crankcase and cylinder block structure are formed a pair of longitudinal liquid channels 24 that are communicated with the jackets 23, respectively, in the cylinders. A cooling liquid line is formed to run between and parallel with the channels 24 and is connected at its one end with a pump 26 which supplies cooling liquid to the jackets 23 through the line 25. The remaining parts of the engine illustrated in FIG. 3 are substantially the same as the corresponding parts depicted in FIGS. 1 through 3 where they are indicated by similar reference numbers.

Furthermore, the both embodiments are structurally alike. The engine of FIG. 4 has its cylinders 1 opposed to each other at 90°. The cylinders 1 projects at their skirt portions 1*a* into the inside of the crankcase 3. The camshaft 7 is disposed to extend between the cylinder skirts 1*a* in the crankcase. The one-piece crankcase and cylinder block structure, which may preferably be of aluminum, is cast with its one side 3*a* opened, an end wall side in which the crankshaft 5 is supported at its one end through bearings (not shown). Also, adjacent to the opening 3*a* between the cylinder skirt 1*a* is formed a space S for housing the camshaft gear, depicted on the leftside of FIG. 5.

Each of the jackets 23 is formed to extend parallel with the axis of the cylinder bore, opened on the side of the cylinder head 20. To facilitate the ejection of the core from its associated cylinder bore in the direction of the arrow A1 (for the right cylinder bank) or A2 (for the left cylinder bank), the inside diameter of each jacket 23 is made to gradually increase as it goes toward the end opening on the cylinder head side.

Figure 5:
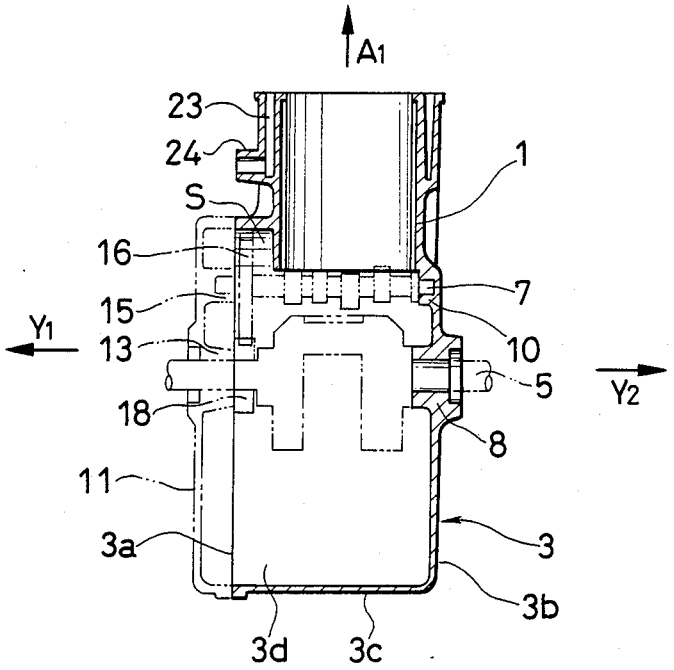
FIG. 5 is a longitudinal cross-sectional view of the cylinder block of the liquid cooling engine, taken along the line V—V of FIG. 4.

Referring then to FIG. 5, the liquid channels 24 are formed to open in the same plane as the end opening 3*a* of the crankcase 3, extending substantially parallel with the crankshaft 5.

With the above arrangement, in casting process, the cylinder block with its liquid jacket layout is cast by ejecting the cores from the cylinder bores and jacket passages in two separate directions indicated by the arrows A1 and A2 in FIG. 4. The cores from the liquid channels 24 are drawn in the operation to pull the core from inside the crankcase in the direction of the arrow Y1.

In either of the above preferred embodiments, the casting of a one-piece crankcase and cylinder block including the tiers of fins or liquid jackets formed in the outside walls of the cylinders and cooling liquid be optimized by distributing the ejection of cores over different directions.

Furthermore, because of the distributed directions of the core ejections, the entire casting process can be achieved by a relatively small casting machine in which the set of mold segments are moved only over a small distance along their respective direction. Thus, designing and assembly can be rationalized and construction costs reduced.

In addition, since the crankshaft is inserted into the crankcase through its opened end wall side, no extra machining and finishing operations required in the case of conventional cast crankcases with its longitudinal wall side opened, such as drilling a large bore in the crankcase end wall enough to permit the insertion of the crankshaft and, after the insertion, filling the bore to a proper size to carry the bearing for the end of the crankshaft.

Thus, the crankshaft can be incorporated in a far much easier manner. Furthermore, there is no additional weight increased by the holder of reinforcing thickness enclosing the crankshaft end bearing filled in the end wall.

Also, the paired cylinders are sufficiently spaced apart from each other, i.e., through 90°, the cores for the cylinder bores can be simplified in structure, making it possible to make the mold for the cylinder block compact.

Moreover, since the camshaft, along with its gear, is housed in a specially defined space inside the crankcase, there is no need to install a housing and oil seals for it, reducing the number of engine components.

Moreover, since the camshaft is isolated in position by the skirt portions of the opposite cylinders that are formed to close in on the camshaft from both side in the crankcase, large amounts of lubricant being splattered from the camshaft in operation are prevented from losing to the cylinders, reducing unnecessary wastage of lubricant.

With respect to the second embodiment, since the liquid cooling channels, which are provided to pass cooling liquid to the cylinder jackets from the pump, are formed to expand parallel with the longitudinal axis of the crankcase, they can be cast in the same operation as the crankcase. This simultaneous process of casting for channels serves to make them liquid-tight.

In addition, since the both channels have their inlet end openings on the same side of the crankcase, piping for cooling liquid supply can be completed in an easier way.

Various modifications and changes are possible without departing from the spirit of the present invention. Accordingly, it should be understood that the descriptive and illustrative materials given herein be employed to illustrate, but not limit, the principles of this invention.

What is claimed is:

1. A one-piece die-cast crankcase and cylinder block casing structure for V-type two-cylinder internal combustion engines, comprising a combined crankcase and cylinder block casing open at one end wall side thereof, the structure being formed so that a bottom wall (*3c*) is declined in gradually widening cross-section in a vertical plane which includes the crankshaft central axis, toward the one end wall side (*3a*) in order to allow removal from a die-casting mold during projection of said structure, the cylinder block portion of the cast casing including right and left cylinder opposed to each other at 90° integrally mounted on a top side of the crankcase, a separate end cover mounted on the one-end wall side to close the crankcase, a first pair of bearings mounted in the separate end cover and an end wall of the crankcase opposite to the one end wall side for supporting the crankshaft, and a second pair of bearings mounted in the separate end cover and an opposite end wall for supporting a camshaft.

2. A one-piece die-cast crankcase and block casing structure as set forth in claim 1, wherein the crankcase is formed to externally swell out at a top end thereof between the cylinders, at a point adjacent to the bearings for the camshaft gear in the separate end cover to form a semicircular space to house a cam drive gear.

3. A one-piece crankcase and cylinder block structure as set forth in claim 1, wherein the outside surface of each of said cylinders is formed into tiers of fins arranged in circle about the axis of the respective cylinder bore.

4. A one-piece die-cast crankcase and cylinder block casing structure as set forth in claim 1, wherein the cylinder block comprises cooling channels provided in outside walls of the cylinders which extend parallel with the axis of the cylinders, said cooling channels being formed in gradually widening cross section toward a top end of the cylinders, to allow the cooling channels to be formed simultaneously with the crankcase and cylinder block structure during die-casting.

5. A one-piece die-cast crankcase and cylinder block casing structure as set forth in claim 4, wherein the cooling channels are formed to open on a side of the cylinder block where the crankcase is closed with the separate end cover.

* * * * *